US009007293B2

(12) United States Patent
Minato

(10) Patent No.: US 9,007,293 B2
(45) Date of Patent: Apr. 14, 2015

(54) DISPLAY, TELEVISION SET AND LIQUID CRYSTAL TELEVISION SET

(75) Inventor: Hiroyuki Minato, Daito (JP)

(73) Assignee: Funai Electri Co., Ltd., Daito-shi (JP)

( * ) Notice: Subject to any disclaimer, the term of this patent is extended or adjusted under 35 U.S.C. 154(b) by 152 days.

(21) Appl. No.: 13/442,275

(22) Filed: Apr. 9, 2012

(65) Prior Publication Data

US 2012/0268664 A1 Oct. 25, 2012

(30) Foreign Application Priority Data

Apr. 25, 2011 (JP) ..... 2011-96944

(51) Int. Cl.
*G09G 3/36* (2006.01)

(52) U.S. Cl.
CPC ..... *G09G 3/36* (2013.01); *G09G 2330/02* (2013.01)

(58) Field of Classification Search
CPC ..... G05F 1/10; H02H 9/00; G09G 5/00
USPC ..... 327/143, 333; 361/90; 315/226; 345/80, 345/99, 790, 100, 204, 211–213; 365/154
See application file for complete search history.

(56) References Cited

U.S. PATENT DOCUMENTS

| | | | | |
|---|---|---|---|---|
| 2004/0012419 | A1* | 1/2004 | Kim et al. | 327/143 |
| 2004/0155693 | A1* | 8/2004 | Ito et al. | 327/333 |
| 2004/0184208 | A1* | 9/2004 | Liu | 361/90 |
| 2007/0058420 | A1* | 3/2007 | Ogiwara et al. | 365/154 |
| 2008/0180870 | A1* | 7/2008 | Tu et al. | 361/93.9 |
| 2008/0278090 | A1* | 11/2008 | Chen et al. | 315/226 |
| 2008/0316195 | A1* | 12/2008 | Li et al. | 345/212 |
| 2009/0051333 | A1* | 2/2009 | Jo et al. | 323/235 |

FOREIGN PATENT DOCUMENTS

| | | | |
|---|---|---|---|
| JP | 4-125685 | A | 4/1992 |
| JP | 7-104711 | A | 4/1995 |
| JP | 10-232652 | A | 9/1998 |

* cited by examiner

*Primary Examiner* — Lun-Yi Lao
*Assistant Examiner* — Johny Lau
(74) *Attorney, Agent, or Firm* — Crowell & Moring LLP

(57) ABSTRACT

This display includes a driving voltage output portion outputting a driving voltage when receiving a display-on signal. The driving voltage output portion includes a delay circuit portion provided between a first switching element and a second switching element for delaying output timing for the driving voltage with respect to input timing for the display-on signal by delaying switching of the second switching element.

16 Claims, 4 Drawing Sheets

DISPLAY, TELEVISION SET AND LIQUID CRYSTAL TELEVISION SET

BACKGROUND OF THE INVENTION

1. Field of the Invention

The present invention relates to a display, a television set and a liquid crystal television set, and more particularly, it relates to a display, a television set and a liquid crystal television set each including a driving voltage output portion outputting a driving voltage for driving a display panel when receiving a display-on signal for driving the display panel.

2. Description of the Background Art

A display including a driving voltage output portion outputting a driving voltage for driving a display panel when receiving a display-on signal for driving the display panel is known in general. In such a display, output timing for the driving voltage must be delayed with respect to input timing for the display-on signal in general, in order to normally drive the display panel.

Therefore, a display capable of delaying output timing for a driving voltage with respect to input timing for a display-on signal is proposed in general, as disclosed in Japanese Patent Laying-Open No. 7-104711 (1995), for example.

The aforementioned Japanese Patent Laying-Open No. 7-104711 discloses a portable terminal (display) including an LCD power source control circuit (driving voltage output portion) outputting a driving voltage for driving an LCD (Liquid Crystal Display) panel portion (display panel) when receiving a power-on signal (display-on signal) for driving the LCD panel portion. This LCD power source control circuit is provided with an LCD front stage transistor (first switching element) entering an ON-state when receiving the power-on signal, an LCD rear stage transistor (second switching element) entering an ON-state when the LCD front stage transistor enters the ON-state thereby outputting the driving voltage through a DC-DC converter and a delay element (delay circuit portion) for delaying output timing for the driving voltage with respect to input timing for the power-on signal. The delay element is provided on an input side of the LCD front stage transistor. In this LCD power source control circuit, the delay element delays switching of the LCD front stage transistor thereby delaying switching of the LCD rear stage transistor, for delaying the output timing for the driving voltage with respect to the input timing for the power-on signal.

In the LCD power source control circuit (driving voltage output portion) of the portable terminal (display) disclosed in the aforementioned Japanese Patent Laying-Open No. 7-104711, however, the delay element (delay circuit portion) is provided on the input side of the LCD front stage transistor (first switching element) for delaying the switching of the LCD front stage transistor, thereby delaying the switching of the LCD rear stage transistor (second switching element). In other words, the delay element provided on the input side of the LCD front stage transistor indirectly delays the switching of the LCD rear stage transistor in the portable terminal disclosed in the aforementioned Japanese Patent Laying-Open No. 7-104711. In the aforementioned Japanese Patent Laying-Open No. 7-104711, therefore, it is disadvantageously difficult to adjust the input timing for the power-on signal (display-on signal) and the output timing for the driving voltage.

SUMMARY OF THE INVENTION

The present invention has been proposed in order to solve the aforementioned problem, and an object of the present invention is to provide a display, a television set and a liquid crystal television set each allowing easy adjustment of a time interval between input timing for a display-on signal and output timing for a driving voltage.

A display according to a first aspect of the present invention includes a display panel and a driving voltage output portion outputting a driving voltage for driving the display panel when receiving a display-on signal for driving the display panel, while the driving voltage output portion includes a first switching element entering an ON-state when receiving the display-on signal, a second switching element, connected to the first switching element, entering an ON-state when the first switching element enters the ON-state and outputting the driving voltage by entering the ON-state and a delay circuit portion provided between the first switching element and the second switching element for delaying output timing for the driving voltage with respect to input timing for the display-on signal by delaying switching of the second switching element.

In the display according to the first aspect of the present invention, as hereinabove described, the delay circuit portion for delaying the output timing for the driving voltage with respect to the input timing for the display-on signal is provided between the first switching element and the second switching element. Thus, the delay circuit portion can directly delay the switching of the second switching element dissimilarly to a case where the delay circuit portion is provided on an input side of the first switching element for indirectly delaying the switching of the second switching element, whereby the time interval between the input timing for the display-on signal and the output timing for the driving voltage can be easily adjusted.

In the aforementioned display according to the first aspect, the switching speed of the second switching element is preferably higher than the switching speed of the first switching element. According to this structure, the time interval from starting of rising of the driving voltage output from the second switching element up to substantially complete rising of the driving voltage can be further reduced as compared with a case where the switching speed of the second switching element is lower than the switching speed of the first switching element. Thus, the display panel can be started at a high speed.

In this case, the first switching element and the second switching element preferably include a first transistor element and a second transistor element respectively. According to this structure, switching can be easily performed through the first transistor element and the second transistor element.

In the aforementioned display having the first switching element and the second switching element including the first transistor element and the second transistor element respectively, the first transistor element preferably includes a bipolar transistor, and the second transistor element preferably includes a field-effect transistor. According to this structure, the field-effect transistor whose switching speed is higher than that of the bipolar transistor can easily reduce the time interval from starting of rising of the driving voltage up to substantially complete rising of the driving voltage.

In the aforementioned display according to the first aspect, the delay circuit portion preferably includes at least a capacitor. According to this structure, the delay circuit portion can easily delay the output timing for the driving voltage by charging and discharging operations of the capacitor at least included therein.

In this case, the delay circuit portion preferably includes a resistor, in addition to the capacitor. According to this structure, the delay circuit portion including the capacitor and the resistor can more easily delay the output timing for the driving voltage.

In the aforementioned display having the delay circuit portion including the resistor in addition to the capacitor, the delay circuit portion is preferably formed by connecting the capacitor and the resistor in parallel with each other. According to this structure, the delay circuit portion formed by connecting the capacitor and the resistor in parallel with each other can more easily delay the output timing for the driving voltage.

In the aforementioned display according to the first aspect, the delay circuit portion is preferably formed to delay the output timing for the driving voltage with respect to the input timing for the display-on signal by delaying the switching of the second switching element and dulling a rising waveform of the driving voltage. According to this structure, the delay circuit portion dulling the rising waveform of the driving voltage can more easily adjust the time interval between the input timing for the display-on signal and the output timing for the driving voltage.

The aforementioned display according to the first aspect preferably further includes a control portion outputting the display-on signal and a display data signal including image data to be displayed on the display panel, the control portion is preferably formed to output the display data signal after a lapse of a prescribed time from outputting of the display-on signal, and the delay circuit portion is preferably formed to delay the output timing for the driving voltage with respect to the input timing for the display-on signal so that the second switching element outputs the driving voltage before the control portion outputs the display data signal. According to this structure, the second switching element outputs the driving voltage before the control portion outputs the display data signal, whereby the display panel can be inhibited from being abnormally driven by the driving voltage output from the second switching element after the control portion outputs the display data signal.

In the aforementioned display according to the first aspect, no delay element is preferably provided on an input side of the first switching element, and the delay circuit portion is preferably provided on an output side of the first switching element and on an input side of the second switching element. According to this structure, the delay circuit portion provided on the output side of the first switching element and on the input side of the second switching element can easily directly delay the switching of the second switching element.

A television set according to a second aspect of the present invention includes a display panel capable of displaying television broadcasting and a driving voltage output portion outputting a driving voltage for driving the display panel when receiving a display-on signal for driving the display panel, while the driving voltage output portion includes a first switching element entering an ON-state when receiving the display-on signal, a second switching element, connected to the first switching element, entering an ON-state when the first switching element enters the ON-state and outputting the driving voltage by entering the ON-state and a delay circuit portion provided between the first switching element and the second switching element for delaying output timing for the driving voltage with respect to input timing for the display-on signal by delaying switching of the second switching element.

In the television set according to the second aspect of the present invention, as hereinabove described, the delay circuit portion for delaying the output timing for the driving voltage with respect to the input timing for the display-on signal is provided between the first switching element and the second switching element. Thus, the delay circuit portion can directly delay the switching of the second switching element dissimilarly to a case where the delay circuit portion is provided on an input side of the first switching element for indirectly delaying the switching of the second switching element, whereby a television set allowing easy adjustment of the time interval between input timing for a display-on signal and output timing for a driving voltage can be constituted.

In the aforementioned television set according to the second aspect, the switching speed of the second switching element is preferably higher than the switching speed of the first switching element. According to this structure, the time interval from starting of rising of the driving voltage output from the second switching element up to substantially complete rising of the driving voltage can be further reduced as compared with a case where the switching speed of the second switching element is lower than the switching speed of the first switching element. Thus, the display panel can be started at a high speed.

In this case, the first switching element and the second switching element preferably include a first transistor element and a second transistor element respectively. According to this structure, switching can be easily performed through the first transistor element and the second transistor element.

In the aforementioned television set having the first switching element and the second switching element including the first transistor element and the second transistor element respectively, the first transistor element preferably includes a bipolar transistor, and the second transistor element preferably includes a field-effect transistor. According to this structure, the field-effect transistor whose switching speed is higher than that of the bipolar transistor can easily reduce the time interval from starting of rising of the driving voltage up to substantially complete rising of the driving voltage.

In the aforementioned television set according to the second aspect, the delay circuit portion preferably includes at least a capacitor. According to this structure, the delay circuit portion can easily delay the output timing for the driving voltage by charging and discharging operations of the capacitor at least included therein.

In this case, the delay circuit portion preferably includes a resistor, in addition to the capacitor. According to this structure, the delay circuit portion including the capacitor and the resistor can more easily delay the output timing for the driving voltage.

In the aforementioned television set having the delay circuit portion including the resistor in addition to the capacitor, the delay circuit portion is preferably formed by connecting the capacitor and the resistor in parallel with each other. According to this structure, the delay circuit portion formed by connecting the capacitor and the resistor in parallel with each other can more easily delay the output timing for the driving voltage.

In the aforementioned television set according to the second aspect, the delay circuit portion is preferably formed to delay the output timing for the driving voltage with respect to the input timing for the display-on signal by delaying the switching of the second switching element and dulling a rising waveform of the driving voltage. According to this structure, the delay circuit portion dulling the rising waveform of the driving voltage can more easily adjust the time interval between the input timing for the display-on signal and the output timing for the driving voltage.

The aforementioned television set according to the second aspect preferably further includes a control portion outputting the display-on signal and a display data signal including image data to be displayed on the display panel, the control portion is preferably formed to output the display data signal after a lapse of a prescribed time from outputting of the display-on signal, and the delay circuit portion is preferably formed to delay the output timing for the driving voltage with respect to the input timing for the display-on signal so that the second switching element outputs the driving voltage before the control portion outputs the display data signal. According to this structure, the second switching element outputs the driving voltage before the control portion outputs the display data signal, whereby the display panel can be inhibited from being abnormally driven by the driving voltage output from the second switching element after the control portion outputs the display data signal.

A liquid crystal television set according to a third aspect of the present invention includes a liquid crystal display panel capable of displaying television broadcasting and a driving voltage output portion outputting a driving voltage for driving the liquid crystal display panel when receiving a display-on signal for driving the liquid crystal display panel, while the driving voltage output portion includes a first switching element entering an ON-state when receiving the display-on signal, a second switching element, connected to the first switching element, entering an ON-state when the first switching element enters the ON-state and outputting the driving voltage by entering the ON-state and a delay circuit portion provided between the first switching element and the second switching element for delaying output timing for the driving voltage with respect to input timing for the display-on signal by delaying switching of the second switching element.

In the liquid crystal television set according to the third aspect of the present invention, as hereinabove described, the delay circuit portion for delaying the output timing for the driving voltage with respect to the input timing for the display-on signal is provided between the first switching element and the second switching element. Thus, the delay circuit portion can directly delay the switching of the second switching element dissimilarly to a case where the delay circuit portion is provided on an input side of the first switching element for indirectly delaying the switching of the second switching element, whereby a liquid crystal television set allowing easy adjustment of the time interval between input timing for a display-on signal and output timing for a driving voltage can be constituted.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a liquid crystal television 100 according to this embodiment is described with reference to FIGS. 1 to 4. The liquid crystal television 100 is an example of the "display", the "television set" or the "liquid crystal television set" in the present invention.

Figure 1:
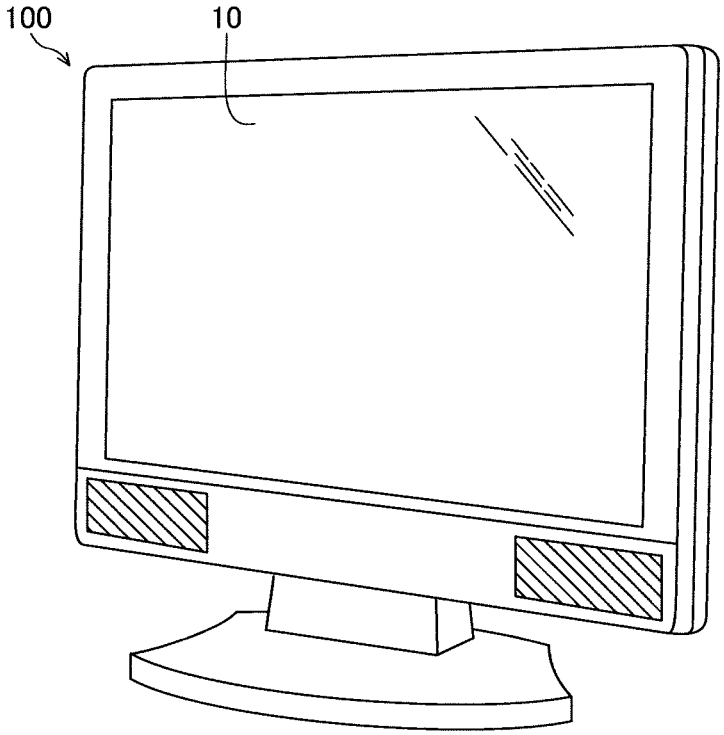
FIG. 1 is a perspective view showing the overall structure of a liquid crystal television according to an embodiment of the present invention.
Figure 2:
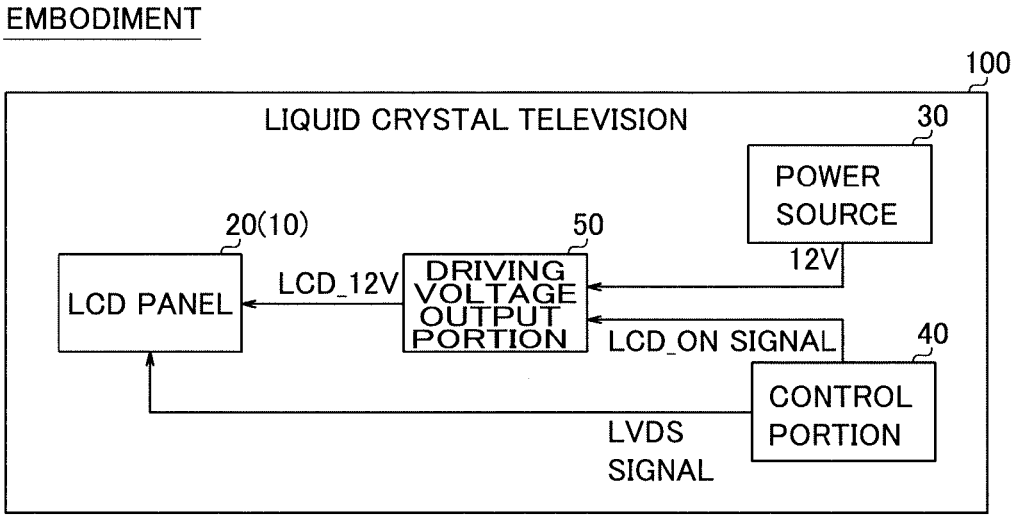
FIG. 2 is a block diagram showing the overall structure of the liquid crystal television according to the embodiment of the present invention.

The liquid crystal television 100 according to this embodiment includes a display portion 10 capable of displaying television broadcasting, as shown in FIG. 1. The liquid crystal television 100 further includes an LCD panel 20 constituting the display portion 10, a power source 30, a control portion 40 and a driving voltage output portion 50, as shown in FIG. 2. The LCD panel 20 is an example of the "display panel" or the "liquid crystal display panel" in the present invention.

As shown in FIG. 2, the power source 30 is connected to the driving voltage output portion 50, and formed to supply a voltage of 12 V to the driving voltage output portion 50.

The control portion 40 is connected to the LCD panel 20, and formed to output an LVDS (Low Voltage Differential Signaling) signal including image data to be displayed on the LCD panel 20 to the LCD panel 20. The control portion 40 is also connected to the driving voltage output portion 50, and formed to output an LCD_ON signal for driving the LCD panel 20 to the driving voltage output portion 50. According to this embodiment, the control portion 40 is formed to output the LVDS signal after a lapse of a prescribed time $\tau$ (see FIG. 4) from outputting of the LCD_ON signal. The LVDS signal and the LCD_ON signal are examples of the "display data signal" and the "display-on signal" in the present invention respectively.

Figure 3:
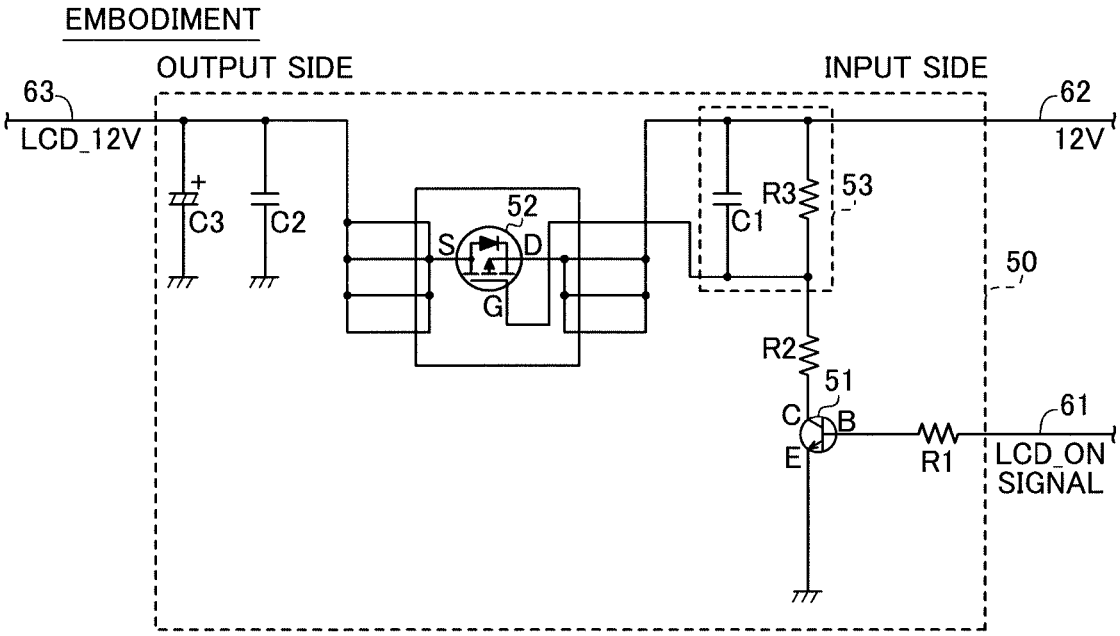
FIG. 3 is a circuit diagram of a driving voltage output portion of the liquid crystal television according to the embodiment of the present invention.

The driving voltage output portion 50 is formed to output a driving voltage (LCD__12V) for driving the LCD panel 20 when supplied with the voltage of 12 V from the power source 30 and receiving the LCD_ON signal from the control portion 40. According to this embodiment, the driving voltage output portion 50 is formed to include a bipolar transistor 51, an FET (Field-Effect Transistor) 52 connected to the bipolar transistor 51 and a delay circuit portion 53 provided between the bipolar transistor 51 and the FET 52 (on an output side of the bipolar transistor 51 and on an input side of the FET 52), as shown in FIG. 3. According to this embodiment, no delay element such as the delay circuit portion 53 is provided on an input side of the bipolar transistor 51. The bipolar transistor 51 is an example of the "first switching element" or the "first transistor element" in the present invention. The FET 52 is an example of the "second switching element" or the "second transistor element" in the present invention.

As shown in FIG. 3, a base B of the bipolar transistor 51 is connected to a signal line 61 for transmitting the LCD_ON signal output from the control portion 40 through a resistor R1. Thus, the bipolar transistor 51 is formed to enter an ON-state when receiving a high-level LCD_ON signal (see FIG. 4) from the control portion 40. A collector C of the bipolar transistor 51 is connected to the delay circuit portion 53 through a resistor R2, while an emitter E thereof is grounded.

A gate terminal G of the FET 52 is connected to an input line 62 for transmitting the voltage of 12 V supplied from the power source 30 through the delay circuit portion 53, and also connected to the collector C of the bipolar transistor 51 through the delay circuit portion 53 and the resistor R2. The resistor R2 and a resistor R3, described later, are provided for resistance division. A drain terminal D of the FET 52 is connected to the input line 62 through the delay circuit portion 53, while a source terminal S thereof is connected to an output line 63 for transmitting the driving voltage (LCD_12V). Thus, the FET 52 is formed to enter an ON-state when the bipolar transistor 51 enters the ON-state. Further, the FET 52 is formed to output the driving voltage through the output line 63 by entering the ON-state. In general, the switching speed of the FET 52 is higher than that of the bipolar transistor 51. Further, the characteristic impedance of the gate terminal G of the FET 52 is higher than that of the base B of the bipolar transistor 51.

The delay circuit portion 53 is formed by connecting a capacitor C1 and the resistor R3 in parallel with each other. Thus, the delay circuit portion 53 is formed to delay switching of the FET 52 by a time constant of the delay circuit portion 53 (resistance (e.g. 100 kΩ) of resistor R3×capacitance (e.g. 0.47 μF) of capacitor C1). A first electrode of the capacitor C1 is connected to the input line 62, while a second electrode thereof is connected to the collector C of the bipolar transistor 51 and the gate terminal G of the FET 52.

Figure 4:
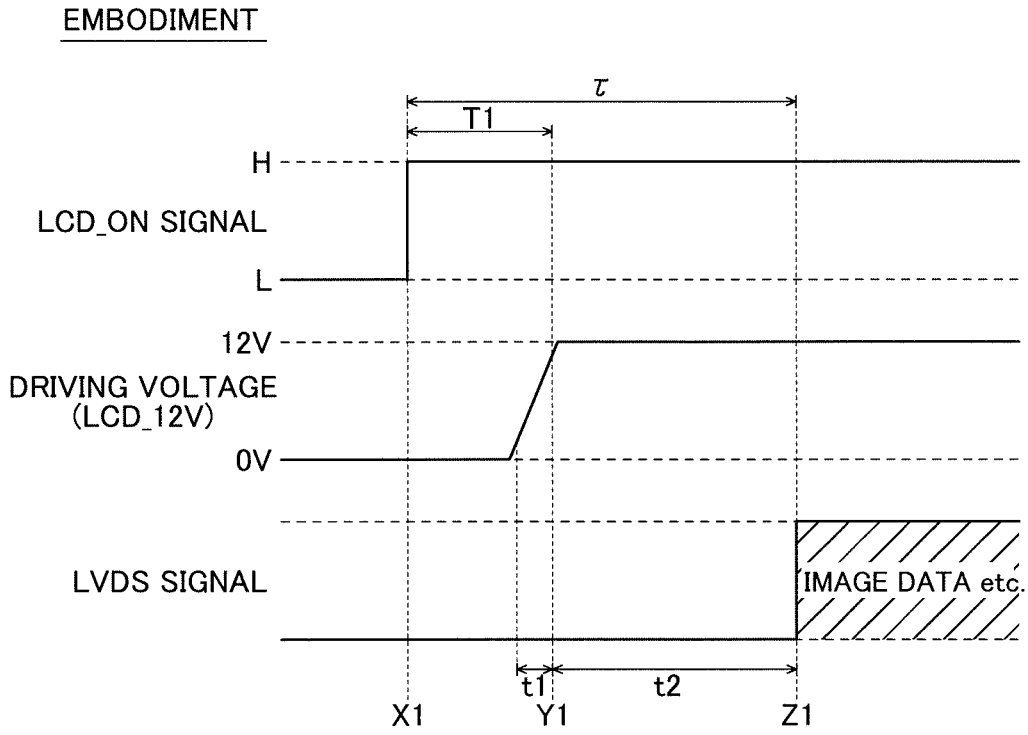
FIG. 4 is a timing chart for illustrating the relation between input timing for an LCD_ON signal, output timing for a driving voltage and output timing for an LVDS signal at a time of displaying images on an LCD panel of the liquid crystal television according to the embodiment of the present invention.

As shown in FIG. 4, the delay circuit portion 53 is formed to delay output timing Y1 for the driving voltage (timing when the driving voltage rises up to about 12 V) by a prescribed time T1 with respect to input timing X1 for the LCD_ON signal (timing when the LCD_ON signal goes high), so that the FET 52 outputs the driving voltage (LCD_12V) before output timing Z1 for the LVDS signal. Further, the delay circuit portion 53 is formed to delay the output timing Y1 (see FIG. 4) for the driving voltage with respect to the input timing X1 (see FIG. 4) for the LCD_ON signal by dulling a rising waveform (see FIG. 4) of the driving voltage.

According to this embodiment, a capacitor C2 for coping with noise and a field-effect capacitor C3 are provided on an output side of the driving voltage output portion 50, as shown in FIG. 3. More specifically, first electrodes of the capacitor C2 and the field-effect capacitor C3 having grounded second electrodes are connected to the output line 63 on the output side of the driving voltage output portion 50. According to this embodiment, the capacitance of the capacitor C2 for coping with noise is set higher than that of the capacitor C1 of the aforementioned delay circuit portion 50.

The relation between the input timing X1 for the LCD_ON signal, the output timing Y1 for the driving voltage (LCD_12V) and the output timing Z1 for the LVDS signal at a time of displaying images on the LCD panel 20 of the liquid crystal television set 100 according to this embodiment is now described with reference to comparative example shown in FIGS. 5 and 6.

In a display such as the liquid crystal television 100 according to this embodiment, output timing for a driving voltage must be delayed by a prescribed time with respect to input timing for a display-on signal in general, in order to normally drive a display panel. More specifically, a time required for rising of the driving voltage (time from starting of rising of the driving voltage up to substantially complete rising of the driving voltage) and a time from an end point of the time required for the rising of the driving voltage (point of time of the substantially complete rising of the driving voltage) up to outputting of a display data signal must be adjusted in the range of values preset as the specification of the display panel.

Figure 5:
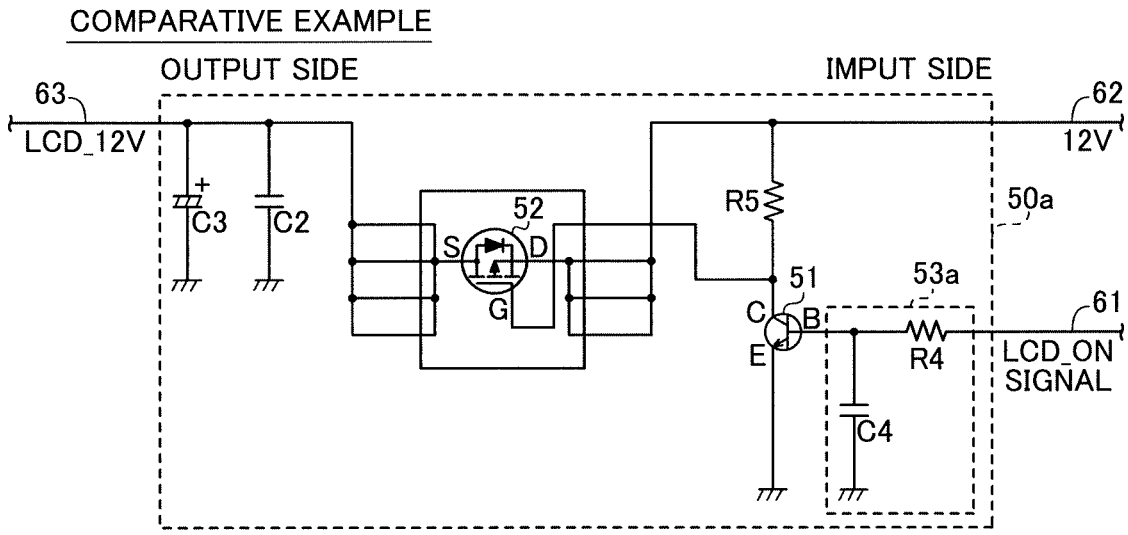
FIG. 5 is a circuit diagram of a driving voltage output portion of a liquid crystal television according to comparative example.
Figure 6:
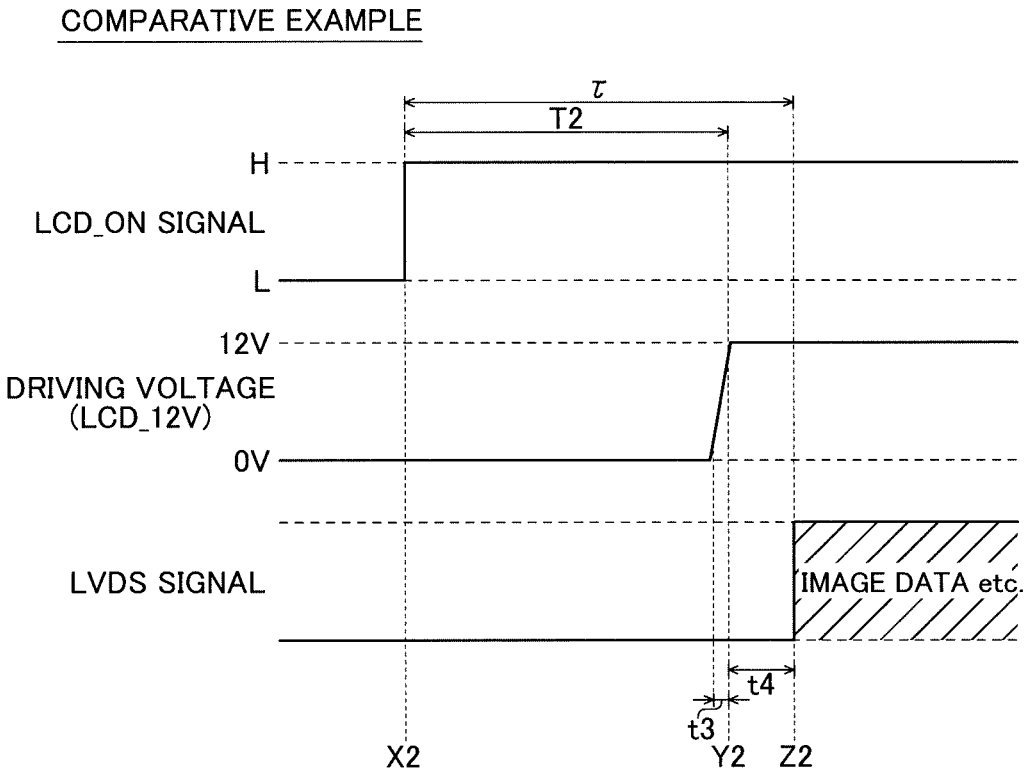
FIG. 6 is a timing chart for illustrating the relation between input timing for an LCD_ON signal, output timing for a driving voltage and output timing for an LVDS signal at a time of displaying images on an LCD panel of the liquid crystal television according to comparative example.

In a liquid crystal television according to comparative example, a delay circuit portion 53*a* is provided on an input side of a bipolar transistor 51, as shown in FIG. 5. More specifically, a base B of the bipolar transistor 51 of a driving voltage output portion 50*a* is connected to a signal line 61 for transmitting an LCD_ON signal through the delay circuit portion 53*a* (a resistor R4 and a capacitor C4). The resistor R4 is provided for connecting the base B of the bipolar transistor 51 and the signal line 61 with each other. The capacitor C4 is so provided that a first electrode thereof is connected to the signal line 61 while a second electrode thereof is grounded. Thus, the delay circuit portion 53*a* is formed to delay switching of an FET 52 by delaying switching of the bipolar transistor 51 by a time constant of the delay circuit portion 53*a* (resistance (e.g. 430 kΩ) of resistor R4×capacitance (e.g. 2.2 μF) of capacitor C4). More specifically, the delay circuit portion 53*a* is formed to delay output timing Y2 for a driving voltage (timing when the driving voltage rises up to about 12 V) by a prescribed time T2 with respect to input timing X2 for the LCD_ON signal (timing when the LCD_ON signal goes high), so that the FET 52 outputs the driving voltage (LCD_12V) before output timing Z2 for an LVDS signal, as shown in FIG. 6.

According to comparative example, as hereinabove described, the delay circuit portion 53*a* is provided on the input side of the bipolar transistor 51 thereby indirectly delaying the switching of the FET 52, and hence the time constant of the delay circuit portion 53*a* must be set somewhat large when adjusting a time t3 (see FIG. 6) required for rising of the driving voltage (LCD_12V) in the range of the aforementioned preset values. If the time constant of the delay circuit portion 53*a* is set large, however, the time T2 (see FIG. 6) from the timing when the LCD_ON signal goes high up to the timing when the driving voltage rises up to about 12 V is so remarkably dispersed that a time t4 (see FIG. 6) from an end point of the time t3 (see FIG. 6) up to outputting of the LVDS signal may be out of the range of the aforementioned preset values. Thus, an LCD panel may abnormally display images in comparative example.

According to this embodiment, on the other hand, no delay element is provided on the input side of the bipolar transistor 51 but the delay circuit portion 53 is provided on the output side of the bipolar transistor 51 and on the input side of the FET 52, whereby the delay circuit portion 53 can directly delay the switching of the FET 52 without delaying the switching of the bipolar transistor 51. Thus, the time constant of the delay circuit portion 53 can be set smaller as compared with comparative example when adjusting a time t1 (see FIG. 4) required for rising of the driving voltage (LCD_12V) in the range of the aforementioned preset values. When the time constant of the delay circuit portion 53 is set small in this manner, the time T1 (see FIG. 4) from the timing when the LCD_ON signal goes high up to the timing when the driving voltage rises up to about 12 V is less dispersed, whereby the time t2 (see FIG. 4) from an end point of the time t1 (see FIG. 4) up to outputting of the LVDS signal is inhibited from going out of the range of the aforementioned preset values. In other words, the LCD panel 20 can be inhibited from abnormally displaying images according to this embodiment.

According to this embodiment, as hereinabove described, the delay circuit portion 53 for delaying the output timing Y1 (see FIG. 4) for the driving voltage (LCD_12V) with respect to the input timing X1 (see FIG. 4) for the LCD_ON signal is provided between the bipolar transistor 51 and the FET 52. Thus, the delay circuit portion 53 can directly delay the switching of the FET 53 dissimilarly to a case where the delay circuit portion 53 is provided on the input side of the bipolar transistor 51 for indirectly delaying the switching of the FET 53, whereby the time interval T1 (see FIG. 4) between the input timing X1 for the LCD_ON signal and the output timing Y1 for the driving voltage can be easily adjusted.

According to this embodiment, as hereinabove described, the switching speed of the FET 52 is higher than that of the bipolar transistor 51. Thus, the time t1 (see FIG. 4) required for rising of the driving voltage (LCD_12V) output from the FET 52 can be further reduced, dissimilarly to a case where the switching speed of the FET 52 is lower than that of the bipolar transistor 51. Therefore, the LCD panel 20 can be started at a high speed.

According to this embodiment, as hereinabove described, the delay circuit portion 53 is formed to include the capacitor C1. Thus, the delay circuit portion 53 can easily delay the output timing Y1 (see FIG. 4) for the driving voltage (LCD_12V) by charging and discharging operations of the capacitor C1 included therein.

According to this embodiment, as hereinabove described, the delay circuit portion 53 is formed by connecting the capacitor C1 and the resistor R3 in parallel with each other. Thus, the delay circuit portion 53 formed by connecting the capacitor C1 and the resistor R3 in parallel with each other can more easily delay the output timing Y1 (see FIG. 4) for the driving voltage (LCD_12V).

According to this embodiment, as hereinabove described, the delay circuit portion 53 is formed to delay the output timing Y1 (see FIG. 4) for the driving voltage (LCD_12V) with respect to the input timing X1 (see FIG. 4) for the LCD_ON signal by delaying the switching of the FET 52 and dulling the rising waveform (see FIG. 4) of the driving voltage (LCD_12V). Thus, the delay circuit portion 53 dulling the rising waveform (see FIG. 4) of the driving voltage can more easily adjust the time interval T1 (see FIG. 4) between the input timing X1 for the LCD_ON signal and the output timing Y1 for the driving voltage.

According to this embodiment, as hereinabove described, the control portion 40 is formed to output the LVDS signal after the lapse of the prescribed time $\tau$ (see FIG. 4) from the outputting of the LCD_ON signal, and the delay circuit portion 53 is formed to delay the output timing Y1 (see FIG. 4) for the driving voltage with respect to the input timing X1 (see FIG. 4) for the LCD_ON signal so that the FET 52 outputs the driving voltage (LCD_12V) before the control portion 40 outputs the LVDS signal. Thus, the FET 52 outputs the driving voltage before the control portion 40 outputs the LVDS signal, whereby the LCD panel 20 can be inhibited from being abnormally driven by the driving voltage output by the FET 52 after the control portion 40 outputs the LVDS signal.

Although the present invention has been described and illustrated in detail, it is clearly understood that the same is by way of illustration and example only and is not to be taken by way of limitation, the spirit and scope of the present invention being limited only by the terms of the appended claims.

For example, while the present invention is applied to the liquid crystal television set in the aforementioned embodiment, the present invention is not restricted to this. The present invention is also applicable to another television set other than the liquid crystal television set, or to another display such as a monitor of a PC (Personal Computer).

While the bipolar transistor and the FET (Field-Effect Transistor) are employed as the first switching element and the second switching element according to the present invention respectively in the aforementioned embodiment, the present invention is not restricted to this. According to the present invention, a transistor (FET, for example) other than the bipolar transistor or another switching element other than the transistor may alternatively be employed as the first switching element. Similarly, a transistor (bipolar transistor, for example) other than the FET or another switching element other than the transistor may alternatively be employed as the second switching element according to the present invention.

While the bipolar transistor and the FET (Field-Effect Transistor) are employed as the first switching element and the second switching element according to the present invention respectively so that the switching speed of the second switching element is higher than that of the first switching element in the aforementioned embodiment, the present invention is not restricted to this. According to the present invention, the switching speeds of the first and second switching elements may alternatively be equalized to each other.

While the delay circuit portion is formed to include the capacitor and the resistor in the aforementioned embodiment, the present invention is not restricted to this. According to the present invention, the delay circuit portion may simply be formed to include at least the capacitor. For example, the delay circuit portion may alternatively be constituted of only the capacitor.

What is claimed is:

1. A display comprising:

a display panel; and a driving voltage output portion outputting a driving voltage for driving said display panel when receiving a display-on signal for driving said display panel, wherein said driving voltage output portion includes:

a first switching element entering an ON-state when receiving said display-on signal, a second switching element, connected to said first switching element, entering an ON-state when said first switching element enters said ON-state and outputting said driving voltage by entering said ON-state, and a delay circuit portion provided between said first switching element and said second switching element for delaying output timing for said driving voltage with respect to input timing for said display-on signal by delaying switching of said second switching element, said second switching element is formed by a switching element whose switching speed is faster than a switching speed of said first switching element, and said delay circuit portion is formed to delay switching of said second switching element formed by the switching element whose switching speed is faster than the switching speed of said first switching element; and said second switching element outputs said driving voltage before a control portion outputs a display data signal including image data to be displayed on said display panel.

2. The display according to claim 1, wherein said first switching element and said second switching element include a first transistor element and a second transistor element respectively.

3. The display according to claim 2, wherein said first transistor element includes a bipolar transistor, and said second transistor element includes a field-effect transistor.

4. The display according to claim 1, wherein said delay circuit portion includes at least a capacitor.

5. The display according to claim 4, wherein
said delay circuit portion includes a resistor, in addition to said capacitor.

6. The display according to claim 5, wherein
said delay circuit portion is formed by connecting said capacitor and said resistor in parallel with each other.

7. The display according to claim 1, wherein
said delay circuit portion is formed to delay said output timing for said driving voltage with respect to said input timing for said display-on signal by delaying said switching of said second switching element and dulling a rising waveform of said driving voltage compared with a rising waveform of said display on signal.

8. The display according to claim 1, wherein
no delay element is provided on an input side of said first switching element, and
said delay circuit portion is provided on an output side of said first switching element and on an input side of said second switching element.

9. A television set comprising:
a display panel capable of displaying television broadcasting; and
a driving voltage output portion outputting a driving voltage for driving said display panel when receiving a display-on signal for driving said display panel, wherein
said driving voltage output portion includes:
a first switching element entering an ON-state when receiving said display-on signal,
a second switching element, connected to said first switching element, entering an ON-state when said first switching element enters said ON-state and outputting said driving voltage by entering said ON-state, and
a delay circuit portion provided between said first switching element and said second switching element for delaying output timing for said driving voltage with respect to input timing for said display-on signal by delaying switching of said second switching element, said second switching element is formed by a switching element whose switching speed is faster than a switching speed of said first switching element, and said delay circuit portion is formed to delay switching of said second switching element formed by the switching element whose switching speed is faster than the switching speed of said first switching element; and
said second switching element outputs said driving voltage before a control portion outputs a display data signal including image data to be displayed on said display panel.

10. The television set according to claim 9, wherein
said first switching element and said second switching element include a first transistor element and a second transistor element respectively.

11. The television set according to claim 10, wherein
said first transistor element includes a bipolar transistor, and said second transistor element includes a field-effect transistor.

12. The television set according to claim 9, wherein
said delay circuit portion includes at least a capacitor.

13. The television set according to claim 12, wherein
said delay circuit portion includes a resistor, in addition to said capacitor.

14. The television set according to claim 13, wherein
said delay circuit portion is formed by connecting said capacitor and said resistor in parallel with each other.

15. The television set according to claim 9, wherein
said delay circuit portion is formed to delay said output timing for said driving voltage with respect to said input timing for said display-on signal by delaying said switching of said second switching element and dulling a rising waveform of said driving voltage compared with a rising waveform of said display on signal.

16. A liquid crystal television set comprising:
a liquid crystal display panel capable of displaying television broadcasting; and
a driving voltage output portion outputting a driving voltage for driving said liquid crystal display panel when receiving a display-on signal for driving said liquid crystal display panel, wherein
said driving voltage output portion includes:
a first switching element entering an ON-state when receiving said display-on signal,
a second switching element, connected to said first switching element, entering an ON-state when said first switching element enters said ON-state and outputting said driving voltage by entering said ON-state, and
a delay circuit portion provided between said first switching element and said second switching element for delaying output timing for said driving voltage with respect to input timing for said display-on signal by delaying switching of said second switching element, said second switching element is formed by a switching element whose switching speed is faster than a switching speed of said first switching element, and said delay circuit portion is formed to delay switching of said second switching element formed by the switching element whose switching speed is faster than the switching speed of said first switching element; and
said second switching element outputs said driving voltage before a control portion outputs a display data signal including image data to be displayed on said display panel.

* * * * *